US008172089B2

(12) United States Patent
Pedain et al.

(10) Patent No.: US 8,172,089 B2
(45) Date of Patent: May 8, 2012

(54) FLOTATION REAGENT FOR MINERALS CONTAINING SILICATE

(75) Inventors: Klaus-Ulrich Pedain, Dietzenbach-Steinberg (DE); Tobias Rau, Dortmund (DE); Michael Patzke, Vienna (AT)

(73) Assignee: Clarient Finance (BVI) Limited, Tortola (VG)

( * ) Notice: Subject to any disclaimer, the term of this patent is extended or adjusted under 35 U.S.C. 154(b) by 789 days.

(21) Appl. No.: 12/298,596

(22) PCT Filed: Apr. 16, 2007

(86) PCT No.: PCT/EP2007/003325

§ 371 (c)(1), (2), (4) Date: Dec. 9, 2008

(87) PCT Pub. No.: WO2007/124853

PCT Pub. Date: Nov. 8, 2007

(65) Prior Publication Data

US 2009/0152174 A1 Jun. 18, 2009

(30) Foreign Application Priority Data

Apr. 27, 2006 (DE) ..... 10 2006 019 561

(51) Int. Cl.
*B03D 1/02* (2006.01)
*B03D 1/01* (2006.01)

(52) U.S. Cl. ..... 209/166

(58) Field of Classification Search ..... 209/166; 252/61; 564/512
See application file for complete search history.

(56) References Cited

U.S. PATENT DOCUMENTS

| | | | | |
|---|---|---|---|---|
| 2,494,132 | A * | 1/1950 | Jayne et al. | 209/166 |
| 2,569,417 | A * | 9/1951 | Jayne et al. | 209/166 |
| 3,459,649 | A | 8/1969 | Mueller et al. | |
| 3,834,533 | A | 9/1974 | McGuire et al. | |
| 4,070,276 | A | 1/1978 | Broman et al. | |
| 4,168,227 | A | 9/1979 | Polgaire et al. | |
| 4,172,046 | A * | 10/1979 | Doi et al. | 516/43 |
| 4,198,288 | A * | 4/1980 | Levine et al. | 209/5 |
| 4,227,996 | A * | 10/1980 | Levine et al. | 209/5 |
| 4,319,987 | A | 3/1982 | Shaw et al. | |
| 4,830,739 | A | 5/1989 | Hellsten et al. | |
| 4,900,431 | A | 2/1990 | Volpi et al. | |
| 4,995,965 | A | 2/1991 | Mehaffey et al. | |
| 4,995,998 | A | 2/1991 | von Rybinski et al. | |
| 5,261,539 | A | 11/1993 | Hancock et al. | |
| 5,439,116 | A | 8/1995 | Van Lierde et al. | |
| 5,540,336 | A | 7/1996 | Schreck et al. | |
| 5,540,337 | A | 7/1996 | Riggs et al. | |
| 5,720,873 | A | 2/1998 | Klingberg et al. | |
| 6,076,682 | A | 6/2000 | Gustafsson et al. | |
| 2009/0114573 | A1 | 5/2009 | Pedain et al. | |

FOREIGN PATENT DOCUMENTS

| | | |
|---|---|---|
| DE | 12 59 264 | 1/1968 |
| DE | 26 01 068 | 7/1976 |
| DE | 41 33 063 | 4/1993 |
| DE | 38 78 440 | 9/1993 |
| FR | 2 700 976 | 8/1994 |
| GB | 1 343 957 | 1/1974 |
| WO | WO 93/06935 | 4/1993 |
| WO | WO 00/62937 | 10/2000 |

OTHER PUBLICATIONS

International Search Report for PCT/EP2007/003325, dated Sep. 19, 2007.

Translation of International Preliminary Examination Report for PCT/EP2007/003325, dated Sep. 19, 2007.

* cited by examiner

*Primary Examiner* — Thomas M Lithgow

(74) *Attorney, Agent, or Firm* — Tod A. Waldrop

(57) ABSTRACT

The invention relates to the use of a compound of formula $$R—N-[A-NH_2]_2 \quad (1)$$

wherein R represents a linear or branched alkyl group or alkenyl group having 6 to 20 carbon atoms while A represents a $C_2$ to $C_4$ alkylene group, as collector in silicate flotation.

12 Claims, No Drawings

FLOTATION REAGENT FOR MINERALS CONTAINING SILICATE

The present invention relates to the use of alkyltriamines in the beneficiation by flotation of minerals containing silicate, and ores.

In reverse flotation, impurities are floated out of the mineral of value. In particular, iron ore, calcium carbonate, phosphate and feldspar are frequently beneficiated in this manner. In many cases minerals containing silicate are the main components of these impurities which cause quality reductions in the end product. These include, in addition to quartz, mica and feldspar, also muscovite and biotite. For example, a high silicate content lowers the quality of iron ore concentrate so that, for example in Brazil, this is purified by flotation by using alkyl ether amines and alkyl ether diamines, in order to be able to produce high-grade steels from the low-silicate concentrate.

Calcium carbonate is freed from silicaceous and colored minerals using quaternary ammonium salts, based on fatty acids or fatty alkylimidazoline compounds. Since calcium carbonate, in addition to kaolin, rutile and talcum, is used as white pigment in paper and plastics production, a degree of whiteness as high as possible and/or a low concentration of colored minerals, is desired. Owing to the hardness of silicate, in paper manufacture, this also leads to increased wear of the calenders of the papermaking machines. Therefore, calcium carbonate, in addition to dry beneficiation, is purified via flotation.

In general, attempts are made by reverse flotation to reduce the silicate content, which in the case of calcium carbonate is frequently characterized as an acid-insoluble component, to below 1.0% by weight. The silicate content in the feed can vary and can occasionally be 10 to 20% by weight.

Silicate collectors which are used are, for example, fatty amines, alkyl ether amines, alkyl ether diamines or quaternary ammonium salt compounds. These are also known under the trade names Flotigam®.

Alkyl ether amines and alkyl ether diamines are mostly used in their partially neutralized forms as partial acetates, as described in U.S. Pat. No. 4,319,987. The reason for this is the better solubility of the partially neutralized amine functions.

The combination of a primary amine with a nitrogenous compound containing an anionic group is disclosed by U.S. Pat. No. 4,830,739.

U.S. Pat. No. 4,995,965 describes the use of methyl-bis(2-hydroxypropyl)cocoammonium methyl sulfate as flotation reagent in order to float silicaceous impurities out of calcite.

U.S. Pat. No. 5,261,539 describes the use of alkoxylated alkyl guanidines and alkoxylated amines for the reverse flotation of calcite.

U.S. Pat. No. 5,540,336 shows the synergistic action of ether amines and anionic collectors for iron ore flotation.

Silicate flotation, inter alia from iron ore, using alkyloxyalkanamines is described in U.S. Pat. No. 5,540,337.

U.S. Pat. No. 5,720,873 describes the combination of quaternary ammonium salts with fatty oxyalkylene compounds for purifying calcium carbonate. This combination achieves an improvement compared with quaternary ammonium salts with respect to separating off acid-insoluble components.

U.S. Pat. No. 6,076,682 describes the combined use of alkyl ether monoamine with alkyl ether diamine for removal of silicate from iron ore by flotation.

WO-A-00/62937 discloses the use of quaternary amines for flotation of iron ore.

The collectors for silicate flotation which are described in the prior art, however, exhibit inadequate results with respect to selectivity and yield. It was therefore an object of the present invention to provide an improved collector for silicate flotation which can be used, in particular in reverse flotation, but also in direct flotation.

The collectors which are currently used for the flotation of silicaceous minerals have relatively high specific dosages, which can lead to environmental problems with respect to the residual content of amine in the concentrate or in the tailings. It is known that amines and amine derivatives have high aquatic and environmental toxicity. Therefore, attempts were made to minimize their specific dosages. In addition, their residual concentration in the end product must be kept as low as possible.

Surprisingly, it has been found that the use of alkyl dipropylene triamines leads to a significant improvement of the flotation of silicaceous minerals compared with the known flotation reagents, wherein the specific dosages can be significantly reduced.

The invention therefore relates to the use of a compound of the formula 1

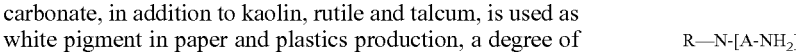

$$R—N-[A-NH_2]_2 \quad (1)$$

where R is a linear or branched alkyl group or alkenyl group having 6 to carbon atoms and A is a $C_2$ to $C_4$ alkylene group, as collector in silicate flotation.

The invention further relates to a process for the flotation of silicaceous mineral, which comprises bringing a compound of the formula 1 into contact with the silicaceous mineral.

The invention further relates to a composition containing 1 to 99% by weight of a collector for silicate flotation, which collector is an alkyl ether amine, alkyl ether diamine, alkylamine or quaternary ammonium salt, and also 1 to 99% by weight of a compound of the formula 1

The compound of formula 1 is also termed hereinafter a collector according to the invention.

The collector according to the invention can be used alone or in combination with other nitrogenous compounds for the flotation of silicate, in particular from iron ore, phosphate or calcium carbonate. Preferred nitrogenous compounds are alkyl ether amines, alkyl ether diamines, alkylamines or quaternary ammonium salts.

The ratio of alkyl ether amine, alkyl ether diamine, alkylamine or quaternary ammonium salt to the compound of the formula is preferably between 95:5 and 50:50 by weight.

R is a linear or branched hydrocarbon group. Further preference is given to R comprising 8 to 18 carbon atoms. Particular preference is given to 2-ethylhexyl, isononane, isodecane and isotridecane and also dodecane moieties.

A is either an ethylene ($—C_2H_4—$), a propylene ($—C_3H_6—$) or a butylene group ($—C_4H_8—$). Preferably, A is a propylene group.

The collectors for silicate flotation, which are an alkyl ether amine, alkyl ether diamine, alkylamine or quaternary ammonium salt, and which can be used together with a compound of the formula 1 are preferably one or more of the compounds of the formula (II) to (V).

These compounds are

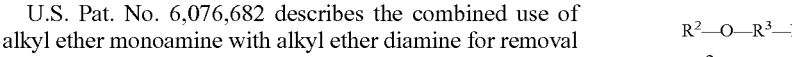

$$R^2—O—R^3—NH_2 \quad (II)$$

where $R^2$ is a hydrocarbon group having 1 to 40, preferably 8 to 32, carbon atoms and $R^3$ is an aliphatic hydrocarbon group having 2 to 4 carbon atoms;

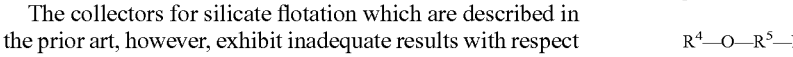

$$R^4—O—R^5—NH—R^6—NH_2 \quad (III)$$

where $R^4$ is a hydrocarbon group having 1 to 40, preferably 8 to 32, carbon atoms, $R^5$ and $R^6$ are one or various aliphatic hydrocarbon groups having 2-4 carbon atoms;

$$(R^7R^8NR^9R^{10})^+B^- \quad (IV)$$

where $R^7$, $R^8$, $R^9$ and $R^{10}$ are one or several hydrocarbon groups having 1 to 22 carbon atoms and $B^-$ is a suitable anion;

$$R^{11}—NH_2 \quad (V)$$

where $R^{11}$ is a hydrocarbon group having 1 to 40, preferably 8 to 32, carbon atoms.

The flotation reagent according to the invention can also be used in combination with frothers and depressants, as are known from the prior art. To avoid, in the case of silicate flotation from iron ore, this being co-discharged, preferably hydrophilic polysaccharides such as, for example, modified starch, carboxymethylcellulose or gum arabic, are added as depressants in dosages of 10 to 1000 g/t.

Silicate flotation is preferably carried out at a pH of 7 to 12, in particular 8 to 11, which is set, for example, using sodium hydroxide.

The use according to the invention can proceed not only in direct silicate flotation but also in reverse silicate flotation. The use according to the invention is also suitable for freeing silicate sand from impurities by separating the silicate sand from the impurities by flotation using the compound of the formula 1.

EXAMPLES

Laboratory flotation experiments were carried out using a Denver flotation cell.

Table 1 presents the flotation results of the collector according to the invention B compared with the standard reagent A. The flotation experiments were carried out on a silicaceous calcium carbonate, wherein the acid-insoluble components make up 14.9% in the feed.

As standard reagent A, a dicocoalkyldimethylammonium chloride was used.

TABLE 1

Effectiveness of the collector B according to the invention compared with the standard collector A = dicocoalkyl-dimethylammonium chloride

| Example | Collector | Dosage in g/t | Acid-insoluble components in the calcite in % | Degree of whiteness in % |
|---|---|---|---|---|
| 1 | A | 305 | 6.4 | 90.4 |
| 2 | A | 355 | 4.2 | 91.2 |
| 3 | A | 404 | 3.1 | 91.4 |
| 4 | A | 488 | 2.3 | 92.3 |
| 5 | A | 728 | 1.1 | 92.0 |
| 6 | B | 121 | 2.8 | 92.0 |

Notably, the reagent according to the invention, in example 6, even at a low dosage of only 121 g/t, shows a significantly lower fraction of acid-insoluble components in the purified concentrate, which the standard reagent does not achieve until above 400 g/t. The reagent according to the invention behaves in a similar manner with respect to the degree of whiteness. At the low dosage this is already 92.0, which is only achieved with the standard reagent at three to four times the dosage.

TABLE 2

Effectiveness of a mixture of the collector according to the invention B and the standard collector A.

| Example | Collector A in g/t | Collector B in g/t | Acid-insoluble components in the calcite in % | Degree of whiteness in % |
|---|---|---|---|---|
| 7 | 222 | 25 | 4.45 | 92.0 |
| 8 | 261 | 29 | 2.98 | 93.8 |
| 9 | 324 | 36 | 1.34 | 94.0 |
| 10 | 369 | 41 | 0.85 | 94.1 |
| 11 | 176 | 70 | 1.86 | 93.3 |
| 12 | 236 | 94 | 0.82 | 93.3 |
| 13 | 272 | 109 | 0.60 | 93.8 |
| 14 | 286 | 114 | 0.40 | 94.1 |
| 15 | 317 | 127 | 0.33 | 93.7 |
| 16 | 365 | 146 | 0.28 | 93.5 |

Examples 7 to 10 are mixtures containing 10% of the collector according to the invention B and 90% of the standard collector A. Examples 11 to 16 are mixtures containing approximately 29% of the collector according to the invention B and approximately 71% of the standard collector A.

The results in examples 7 to 10 and 11 to 16 show a generally lower fraction of acid-insoluble components and also a higher degree of whiteness in the concentrate compared with the standard reagent in examples 1 to 5.

The flotation reagent according to the invention is usable in a broad pH range, for example 6 to 12, preferably 6 to 8, and is added to the aqueous pulp in a concentration between preferably 0.001 and 1.0 kg/tonne of raw material.

Using the flotation reagent according to the invention, a significant improvement of yields and selectivity is achieved compared with the collectors of the prior art. Tables 1 to 2 show a significantly increased degree of whiteness and also a lower acid-insoluble fraction in the calcite compared with the corresponding standard reagent.

The invention claimed is:

1. A process for the flotation of silicaceous mineral, which comprises bringing the silicaceous material into contact with at least one flotation reagent according to formula 1

$$R—N-[A-NH_2]_2 \quad (1)$$

where R is a linear or branched alkyl group or alkenyl group having 6 to 20 carbon atoms and A is a $C_2$ to $C_4$ alkylene group.

2. The process of claim 1, wherein R is a linear aliphatic hydrocarbon moiety having 8 to 18 carbon atoms.

3. The process of claim 1, wherein R is a 2-ethylhexane, isononane, isodecane, decane, dodecane or isotridecane moiety.

4. The process of claim 1, wherein A in formula 1 is a propylene group (—$C_3H_6$—).

5. The process of claim 1, wherein said process is a process for reverse flotation of silicaceous minerals from the group consisting of iron ore, phosphate ore and calcium carbonate.

6. The process of claim 1, wherein said process comprises a process for purifying silicate sand.

7. The process of claim 1, wherein said process comprises a process for the flotation of quartz, mica, feldspar or muscovite from the group consisting of iron ore, calcium carbonate, phosphate ore and mixtures thereof.

8. The process of claim 1, wherein the ore compises between 0.1 and 50% by weight silicate.

9. The process of claim 1, wherein the at least one flotation reagent further comprises a frother and a depressant.

10. The process of claim 1, wherein said contacting occurs in a pH range of 7 to 12.

11. The process of claim 1, wherein a ratio of he at least one flotation reagent to the silicaceous material ranges from 0.001 to 1.0 kg per tonne of silicaceous material.

12. The process of claim 1, wherein the at least one flotation reagent further comprises at least one further nitrogenous silicate collector selected from the group consisting of alkyl ether amines, alkyl ether diamines, alkylamines, quaternary ammonium salts, and mixtures thereof.

* * * * *

UNITED STATES PATENT AND TRADEMARK OFFICE

CERTIFICATE OF CORRECTION

PATENT NO. : 8,172,089 B2
APPLICATION NO. : 12/298596
DATED : May 8, 2012
INVENTOR(S) : Klaus-Ulrich Pedain, Tobias Rau and Michael Patzke It is certified that error appears in the above-identified patent and that said Letters Patent is hereby corrected as shown below:

Title page, should read;

(73) Assignee: Clariant Finance (BVI) Limited, Tortola (VG)

Signed and Sealed this
Tenth Day of July, 2012

David J. Kappos

David J. Kappos
*Director of the United States Patent and Trademark Office*